US008091702B1

(12) United States Patent
Keip

(10) Patent No.: US 8,091,702 B1
(45) Date of Patent: Jan. 10, 2012

(54) INTEGRATED CUP CARRIER

(76) Inventor: Charles P. Keip, Byron Center, MI (US)

( * ) Notice: Subject to any disclaimer, the term of this patent is extended or adjusted under 35 U.S.C. 154(b) by 0 days.

(21) Appl. No.: 12/799,801

(22) Filed: May 3, 2010

(51) Int. Cl.
*B65D 75/00* (2006.01)

(52) U.S. Cl. ..... 206/171; 206/175; 206/194; 206/197

(58) Field of Classification Search ..... 206/143, 206/167, 170, 171, 174, 175, 193, 194, 197, 206/199, 200, 427, 549; 229/87.4, 117.14; 294/87.2
See application file for complete search history.

(56) References Cited

U.S. PATENT DOCUMENTS 3,565,323 A * 2/1971 Katzenmeyer ..... 229/117.14
3,640,380 A 2/1972 Huffman
3,744,704 A * 7/1973 Struble ..... 206/194
3,780,906 A * 12/1973 Katzenmeyer ..... 206/170
4,155,502 A * 5/1979 Forte ..... 294/146
4,196,807 A * 4/1980 Brom ..... 206/427
5,738,217 A * 4/1998 Hunter ..... 206/549
5,743,389 A 4/1998 Cutler et al.
5,927,502 A 7/1999 Hunter
D421,898 S 3/2000 Strange
6,230,882 B1 * 5/2001 Wischusen, III ..... 206/194
6,298,992 B1 10/2001 Tsao

* cited by examiner

*Primary Examiner* — Luan K Bui
(74) *Attorney, Agent, or Firm* — Harpman & Harpman

(57) ABSTRACT

A folding cup holder carrier that provides for multiple cup carrying from a single folded sheet material blank. The cup carrier has a central handle with opposing tapered sides with multiple apertured hinged cup engagement flaps formed thereon. A base is defined between said respective sides below said multiple apertures to support a cup's bottom once placed through the corresponding apertures and retained by resilient retainment by the hinge flaps.

3 Claims, 4 Drawing Sheets

INTEGRATED CUP CARRIER

BACKGROUND OF THE INVENTION

1. Technical Field

This invention relates to cup carrier of a disposable one-time use configuration. Such holders are formed from folded or molded cardboard and will allow for easy transport of multiple drinks with a single hand. Such cup carriers are principally found in fast food establishments and are thrown away after a single one-time use.

2. Description of Prior Art

Prior art devices of this type have used a variety of different folding configurations; see for example U.S. Pat. Nos. 4,196,807, 5,927,502, 3,640,380, 6,298,992, 5,743,389 and D421,898.

In U.S. Pat. No. 4,196,807 the universal cup carrier is disclosed formed of a single folded fiber board carrier configuration having a central handle portion and convergent pairs of apertured panels hinged together. The cups are slid through the apertures interengaging the multi-hinged panels which engage and hold the cup on its annular side surfaces.

U.S. Pat. No. 5,927,502 is directed towards a food and beverage container carrier in which a cardboard blank is cut and scored so as to form a carrier configuration with a central handle so as to provide cups to extend through apertures within the sidewalls in which the cups are wedgeably secured in the apertured openings.

U.S. Pat. No. 3,640,380 discloses a portable food and drink carrier which has a general box-like configuration in which the sidewalls of the box have a hinged circular cut-out which is deployed horizontal to the sidewall and provides a ring with an apertured acceptance for a cup. A second form of the invention shows a central handle portion and panel in which apertured rings are hingeably deployed so as to accept a cup vertically adjacent to the panel with a base extending from the panel at right angles on which the cup is rested.

U.S. Pat. No. 6,298,992 discloses a foldable food and beverage carrying device which includes a base member having a bottom hole for insertion of a food container and positioning of a beverage on top of the container supported by a hinged apertured ring from oppositely disposed sidewall panels with a handle grip in its top portion. U.S. Pat. No. 5,743,389 claims a reversible food and beverage vessel carrier which provides a flat paper stock blank and is appropriately die cut and folded to form an inverted box with upstanding sidewalls forming a handle at the top. The box is configured with openings through which beverage containers can be selectively and wedgeably positioned.

Finally, in design patent 421,898 a bag and beverage cup holder is disclosed which shows a cardboard configuration forming a base with upstanding sidewalls and a central handle portion. Oppositely disposed cut-outs in the sidewalls hingeably deploy a container receiving ring through which a beverage container is positioned and rests on a portion of the base which extends outwardly through an opening in vertical alignment with the support ring cut-out.

SUMMARY OF THE INVENTION

A folded cup carrier configuration that provides for integrated multiple positioning support and transportation of beverage type cups. The container is formed from a single folded blank of cardboard material having an integrated base and angularly disposed upstanding sidewalls culminating in a vertically ascending handle therebetween. Cut-outs are formed in the respective sidewalls and fold score lines so that imparted folding input will provide for a resilient cup engagement flap having a contoured edge to engage the respective arcuate sides of cups supporting same once positioned through the openings in the sidewalls and supported on the base element therebelow.

DETAILED DESCRIPTION OF THE INVENTION

Figure 1:
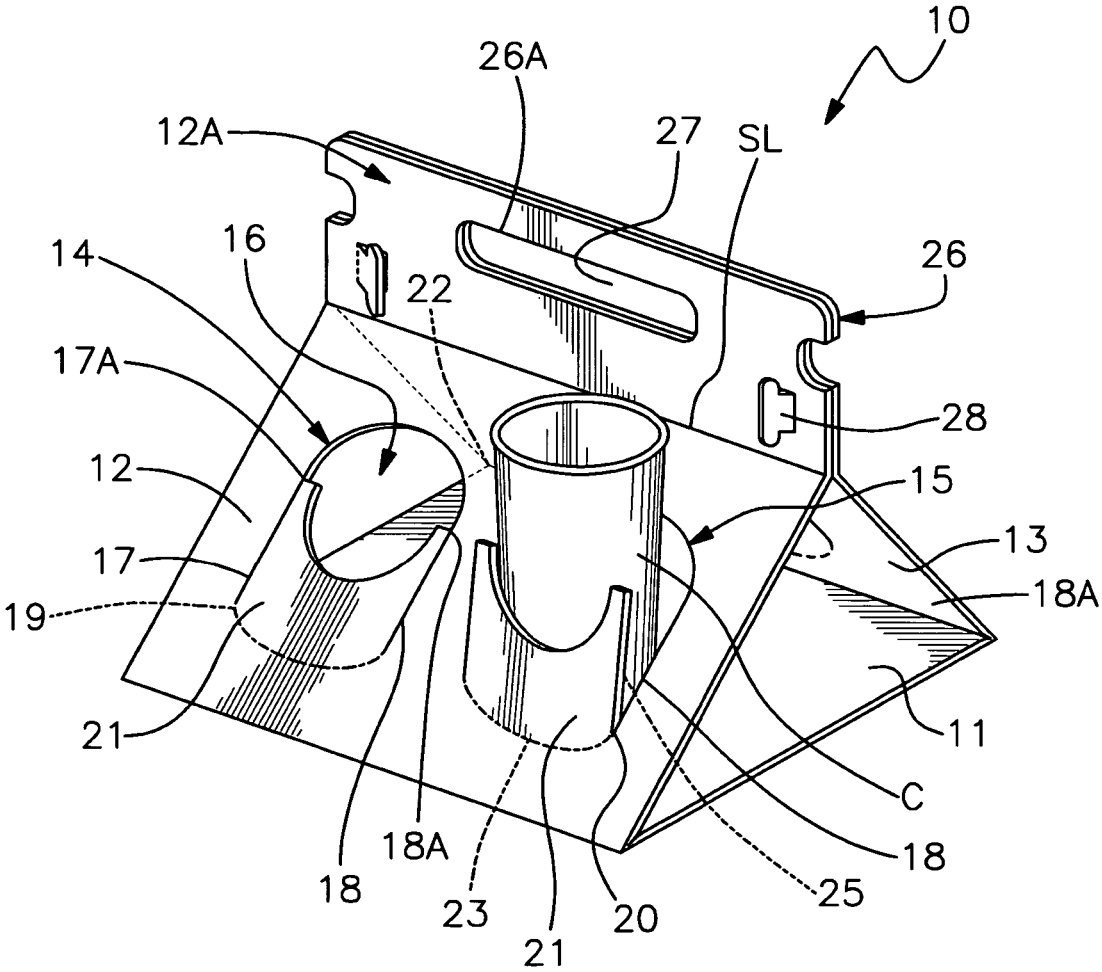
FIG. 1 is a perspective view of the cup carrier of the invention assembled for use.
Figure 2:
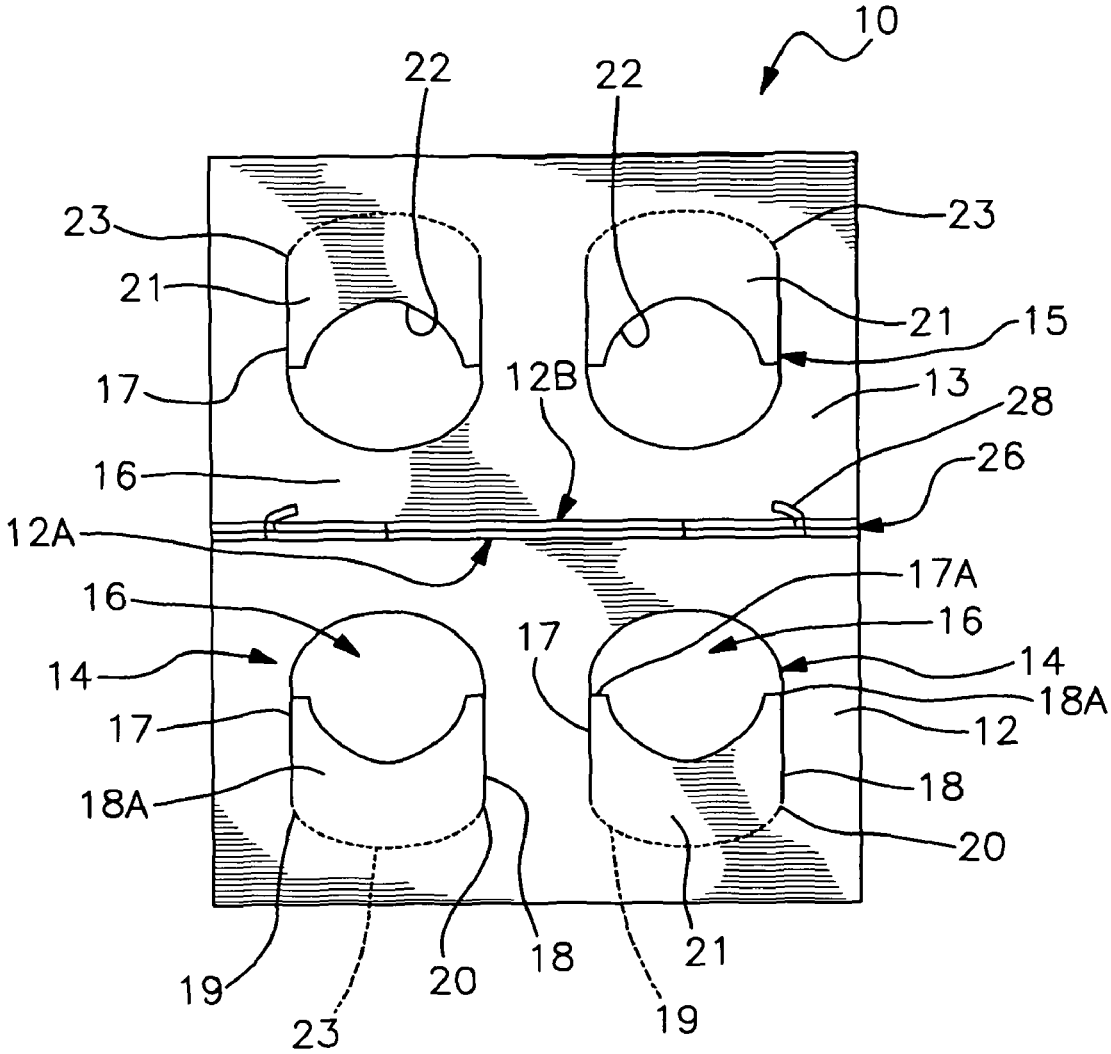
FIG. 2 is a top plan view thereof.

Referring to FIGS. 1 and 2 of the drawings, a beverage carrier of the present invention can be seen comprising a blank adapted to be cut and folded into a generally elongated triangular construction including a continuous surface defining base 11 with oppositely disposed effacing inclined ascending sidewalls 12 and 13 extending integrally therefrom. Each of the corresponding sidewalls 12 and 13 preferably have a pair of cup receiving cut-outs at 14 and 15 therewithin respectively. Each of the cut-outs have an elliptical opening at 16 with spaced parallel cut lines 17 and 18 extending from the respective transverse translateral tangent points indicated at 17A and 18A in FIG. 2 of the drawings. Key fold cuts 19 and 20 are made inwardly at the respective cut line ends defining of cap retainment flaps 21 therebetween. Each of the so-defined retaining flaps 21 is characterized by a contoured concave free end edge 22 and a flap fold score line 23 shown in broken lines extending between the hereinbefore described key fold cuts 19 and 20.

The contoured concave free end edge 22 extends between co-planar horizontally aligned edges 24 and 25 thus defining the hereinbefore described retainment flaps 21 which are folded outwardly along the fold score line 23 for insertion of a cup C as shown in broken lines.

Each of the inclined sidewalls 12 and 13 has an integrated extending handle formation portion 12A and 13A delineated by a cross fold score line SL which once folded as assembled are in abutting vertical orientation joining together to define a working hand grip area 26.

Co-aligned hand grip cut-outs 26A and 26B therein define when joined as so indicated a true hand grip insertion portal 27 therethrough configured so as clearly seen in FIG. 1 of the drawings.

Assembly alignment notches 20A and 20B are formed in their respective opposing edges of the handle formation portions 12A and 13A in longitudinal alignment with hereinbefore described hand grip cut-outs 26A and 26B.

Interengagement contact locking tabs 28 are selectively formed in the handle formation portion 13A and co-aligned with apertures 27 for registration restriction therewithin of the handle formation portion 12A thus securing the handle portions together and forming the retainment for the formation of the beverage carrier 10. When user engaged as aligned by the corresponding assembled alignment notches 20A and 20B providing a registration area for the user's thumbs, not shown, for ease and accuracy of assembly, as noted.

Figure 3:
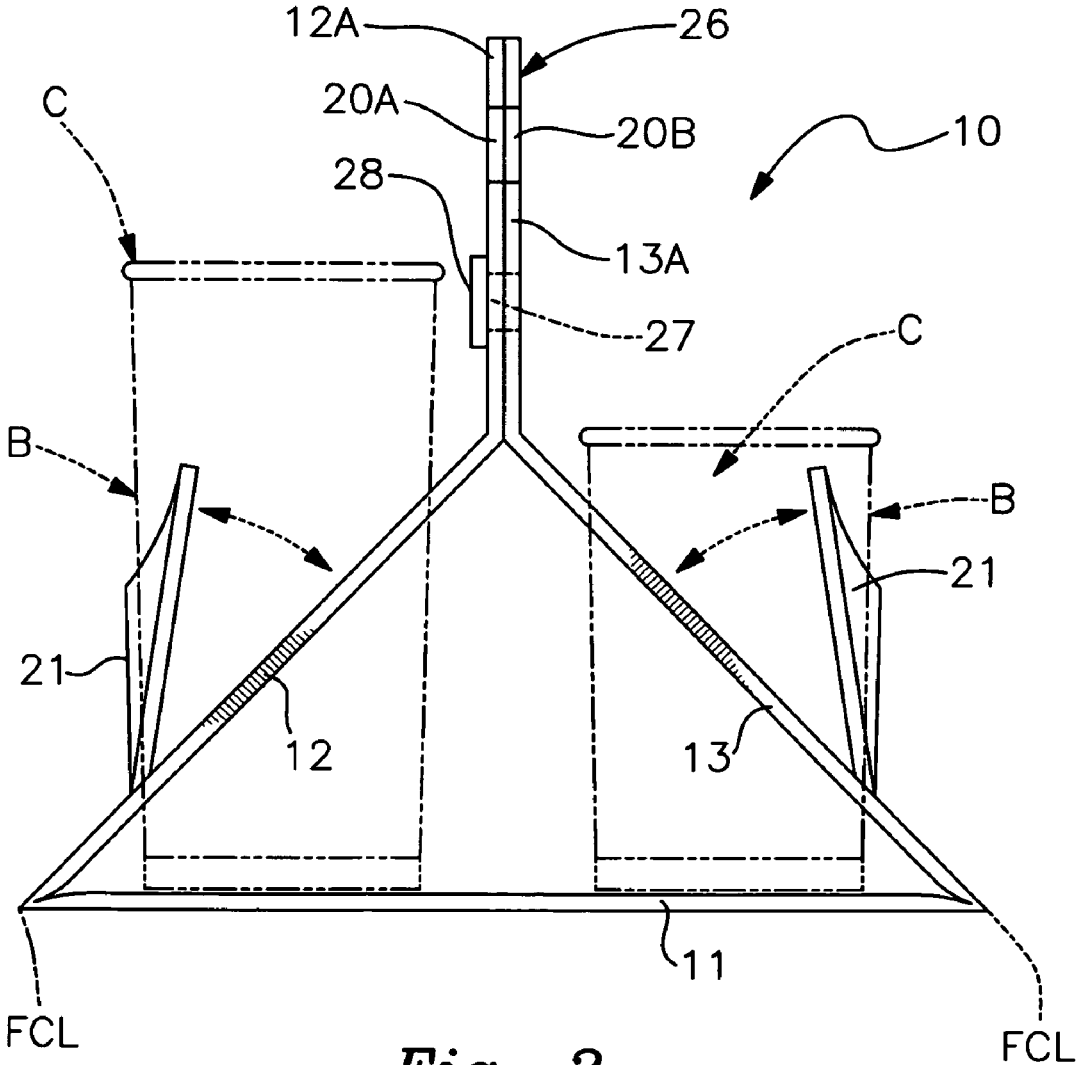
FIG. 3 is an end elevational view thereof with the cup representation shown in broken lines positioned therewithin.

It will be seen that due to the unique configuration of the retainment flaps 21 which are once folded open between their angularly disposed fold cuts 19 and 20, hereinbefore described, that the so-configured flaps 21 will resiliently engage arcuate surface B of the beverage cup C shown in broken lines imparting a containment and stabilization thereto once positioned in the holder 10 through the respective elliptical opening cut-out 16 which are so enlarged once the flaps 21 have been deployed, as best seen in FIG. 3 of the drawings. Accordingly, the cup C will rest on the continuous integral surface base 11 which extends between the respective inclined sidewalls 12 and 13 imparting structural strength and stability to the beverage carriage 10 of the invention.

Figure 4:
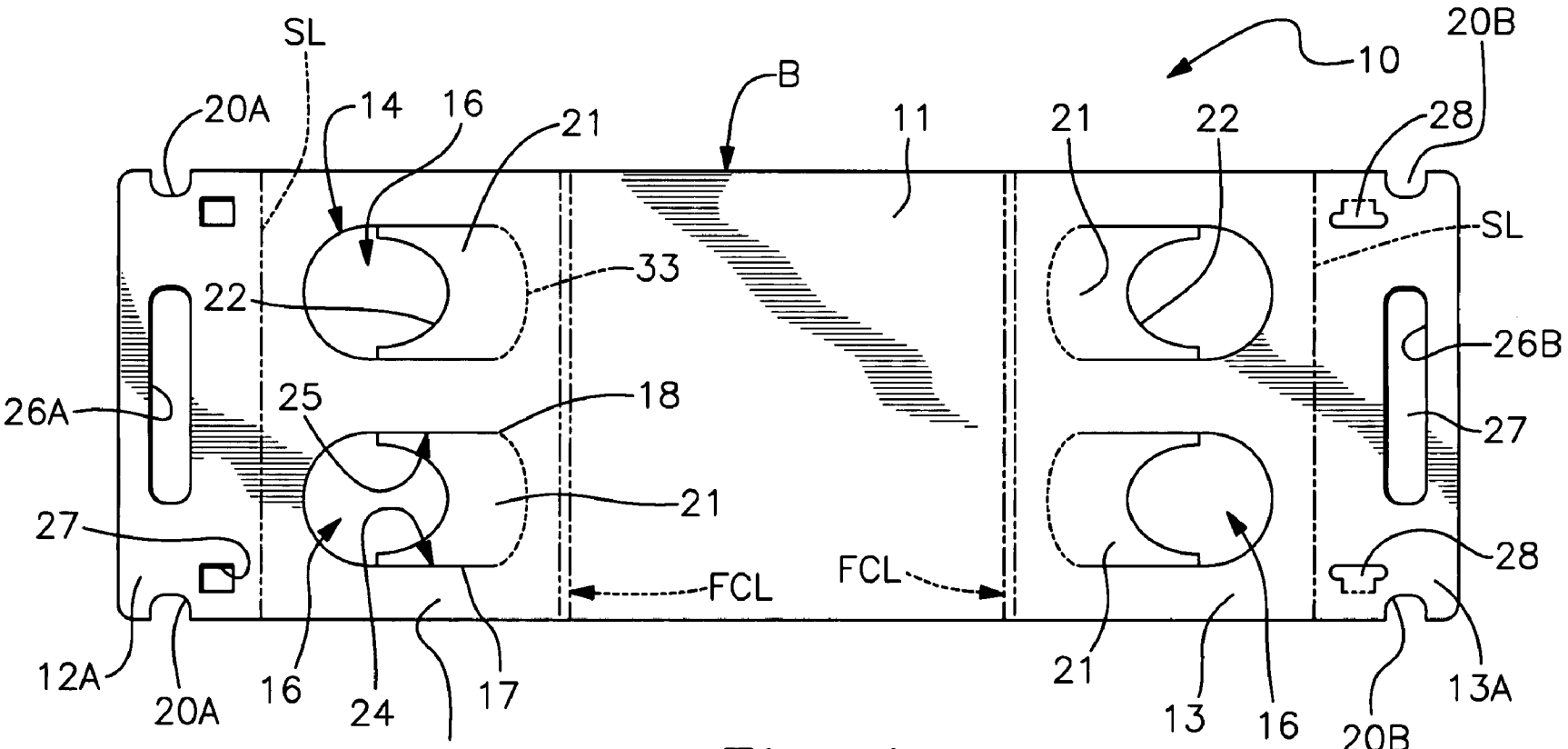
FIG. 4 is a top plan view of the cup carrier's die cut cardboard blank and indicated fold lines before formation.

Referring to FIG. 4 of the drawings, the cardboard blank B can be seen in its pre-assembled form which clearly shows the orientation of the respective sidewalls 12 and 13 with fold crush lines FCL transversely thereacross. Their appropriate elliptical cut-outs at 16 and the formation of the hereinbefore described cup retainment flaps 21 between the respective cut lines 17 and 18 and fold line 23 delineated between the key fold cuts 19 and 20 at their terminal ends.

The orientation and positioning of the assembly alignment notches 20A and tabs 208 on the respective handle formation portions 12A and 13A and longitudinal alignment with the respective handle grip cut-outs 26A and 26B therewithin which upon assembly via the fold score lines SL and blank.

It will thus be seen that a new and novel integrated self-contained folding cup holder beverage carrier has been illustrated and described and it will be apparent to those skilled in the art that various changes and modifications may be made therein without departing from the spirit of the invention.

Therefore, I claim:

1. A folding cup holder carrier for carrying multiple cups at one time comprises, an upstanding hand grip comprising first and second handle formation portions having aligned hand grip openings therein, locking tabs in said first handle formation portion and locking tab engagement apertures in said second handle formation portion securing said handle formation portions together, a pair of inclined sidewalls extending integrally from said respective handle formation portions, each of said inclined sidewalls having at least one cup receiving cut-out therewithin, a continuous solid surface cup engagement support base hinged to and extending between said respective inclined sidewalls, each of said cup receiving cut-outs of an elliptical shape having an identical hinged integral cup engagement flap and having a pair of relief cuts defining a hinge flag line extending along the entire lower base thereof extending from within said cut-out engaging with the respective cup in spaced relation to the planar surface of said inclined sidewalls.

2. The folding cup holder carrier set forth in claim 1 wherein said first and second handle formation portions have hinge lines thereacross defining said extending inclined sidewalls therefrom.

3. The folding cup holder carrier set forth in claim 1 wherein said continuous solid surface cup engagement support base hinged to and between said respective inclined sidewalls is so defined by respective transverse hinge lines of a crush line configuration.

* * * * *